US005738080A

United States Patent [19]

Brocco, Jr.

[11] Patent Number: 5,738,080

[45] Date of Patent: Apr. 14, 1998

[54] BOW HANGER FOR AN ARCHERY BOW

[76] Inventor: Philip M. Brocco, Jr., R.D. #1, Box 107B, Dawson, Pa. 15428

[21] Appl. No.: 598,895

[22] Filed: Feb. 9, 1996

[51] Int. Cl.[6] ..... F41B 5/14

[52] U.S. Cl. ..... 124/86; 124/23.1; 248/205.2; 248/227.4; 248/692

[58] Field of Search ..... 124/23.1, 86, 88, 124/89; 248/205.2, 214, 227.4, 692

[56] References Cited

U.S. PATENT DOCUMENTS

| | | | |
|---|---|---|---|
| 3,055,354 | 9/1962 | Gates | 124/88 |
| 3,204,626 | 9/1965 | Morneau | 124/88 X |
| 3,572,312 | 3/1971 | Foster | 124/88 X |
| 4,094,488 | 6/1978 | Bryant | 248/692 |
| 4,548,375 | 10/1985 | Moss | 248/205.2 |
| 4,759,963 | 7/1988 | Uso et al. | 248/205.2 X |
| 4,777,666 | 10/1988 | Beverlin | 124/88 X |
| 4,889,307 | 12/1989 | Klansek | 124/88 X |
| 4,951,910 | 8/1990 | March | 248/205.2 X |
| 5,104,076 | 4/1992 | Goodall | 248/205.2 |
| 5,341,792 | 8/1994 | Pucillo | 124/89 |

*Primary Examiner*—John A. Ricci
*Attorney, Agent, or Firm*—Nils H. Ljungman and Associates

[57] ABSTRACT

A hanger for supporting an archery bow on a branch or other horizontal structure. The bow hanger includes a hook element and a base structure with a flexible strap. The flexible strap is provided with a series of Velcro fastening strips to be engaged with complementary Velcro fastening strips affixed onto a portion of the bow. The bow hanger can be attached to the bow by wrapping the flexible strap around the complementary Velcro fastening strips of the bow and engaging the Velcro fastening strips of the flexible strap with the Velcro fastening strips of the bow. By looping the hook element of the bow hanger on a tree branch, for example, the bow can thereby be supported without causing damage to the bow.

8 Claims, 4 Drawing Sheets

BOW HANGER FOR AN ARCHERY BOW

BACKGROUND OF THE INVENTION

1. Field of the Invention

The present invention generally relates to a hanger for supporting an archery bow on a branch or other substantially horizontal structure. The bow hanger includes a hook element and a base element for attachment to an archery bow.

2. Background Information

While hunting or target shooting with an archery bow, it may frequently be necessary to lay the bow aside for a number of reasons. The archer or hunter may, for example, need to set the bow aside to examine other equipment, to prepare a hunting stand or target, or to retrieve arrows from the target. It is highly undesirable to set the bow directly on the ground because doing so can cause damage to the bow. When the bow is left on the ground, the bow may be accidentally stepped on or the bow may sustain structural damage due to contact with water or snow from the ground.

While hunting or target shooting, an archer or hunter may resort to leaning the bow against a tree or hanging the bow from a nail. By doing so, the bark of the tree or the head of the nail may irreparably mar the surface of the bow.

Similar problems exist in the storage of the bow when the bow is not in use. Even though the bow may be beautifully designed and may be of considerable value, the owner may store the bow in a manner that can cause damage to the bow. The owner may attempt to store the bow, for example, by hanging one end of the bow on a nail. The owner may also choose to store the bow on a wooden or metal rack whereby the limbs of the bow are in direct contact with the rugged surface of the rack. During storage of the bow, the nail or metal rack can place a constant and direct force on the surface of the bow resulting in damage to the bow. And even though devices have been made specifically for supporting a bow, these devices have proved to be expensive and/or ineffective.

A device is disclosed, for example, in U.S. Pat. No. 4,889,307 in which a bolt is required to attach a bow hanger to a bow. By using a bolt to attach the hanger to the bow, the bolt must be inserted into the bow itself. The insertion of the bolt directly into the bow can cause damage to the bow. Furthermore, to remove the hanger device from the bow, it is necessary to unscrew the bolt. By repeatedly removing the hanger device from the bow, the repeated loosening of the bolt can cause the bolt threads to splinter the wooden or fiberglass material of the bow and thus damage the bow. As a result of such repeated damage to the bow material, eventually, the bolt may no longer fasten firmly within the bow, thereby rendering the bow hanging device ineffective.

OBJECT OF THE INVENTION

An object of the present invention is to provide a bow hanger which can effectively support a how, without causing damage to the bow. Another object of the present invention is to provide a hanger for a bow, which bow hanger can be quickly and easily removed or attached to the bow.

SUMMARY OF THE INVENTION

The present invention teaches that these objects can be achieved by providing a bow hanger with a hook element and a base structure firmly attached thereto. The base structure can be designed as a flexible strap including fastening structures, which fastening structures can firmly attach the bow hanger to the bow.

The present invention teaches that the hook element can advantageously be fastened to a base structure of the bow hanger.

In accordance with one embodiment of the present invention, the flexible strap can preferably include two flexible arms, which flexible arms can wrap around a portion of the bow. The flexible arms can have a series of VELCRO strips attached thereon, which VELCRO strips can include "hook" or "loop" VELCRO fasteners. VELCRO-brand fasteners typically include one portion having hooks and another complementary portion having loops or eyelets, in which loops or eyelets the hooks of the hood portion are engaged upon the application of pressure. A complementary hook or loop portion of VELCRO can be affixed to a portion of the bow itself whereby the flexible arms of the flexible strap can be wrapped around and firmly attached to the bow. In addition, the flexible strap can be fastened at its ends by additional complementary hook and loop fasteners attached thereto.

The bow hanger can be essentially easily and quickly released from the bow. The hanger can be released from the bow by simply pulling one end of the flexible strap thereby opening the flexible strap, followed by pulling the VELCRO strips of the flexible strap away from the VELCRO strip of the bow.

When the word "invention" is used in this specification, the word "invention" includes "inventions", that is, the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

One aspect of the present invention resides broadly in a bow hanger for an archery bow, the bow hanger comprising: means for supporting an archery bow; the supporting means having a first portion and a second portion; the first portion of the supporting means comprising hook means; the second portion of the supporting means comprising a flexible material; means for releasably attaching the supporting means substantially adjacent an upper portion of an archery bow; and the means for releasably attaching being disposed on at least one of: the flexible material of the supporting means; and substantially adjacent the upper portion of an archery bow.

Another aspect of the present invention resides broadly in an archery bow comprising: a handle section having an upper end and a lower end; the handle section defining a longitudinal axis extending substantially between the upper end and the lower end of the handle section; an upper limb section extending from the upper end of the handle section; a lower limb section extending from the lower end of the handle section; the upper limb section and the lower limb section each having a free end facing away from the handle section; a bowstring extending between the free end of the upper limb section and the free end of the lower limb section; the bowstring being disposed rearwardly of the handle section; means for supporting the archery bow; the supporting means having an upper portion and a lower portion; the upper portion of the supporting means comprising hook means; the hook means being disposed substantially parallel to the longitudinal axis; the lower portion of the supporting means comprising a flexible material; means for releasably attaching the supporting means substantially adjacent the upper end of the handle section of the archery bow; and the means for releasably attaching being disposed on at least one of: the flexible material of the supporting means; and substantially adjacent the upper end of the handle section of the archery bow.

BRIEF DESCRIPTION OF THE DRAWINGS

The present invention is explained in greater detail below with reference to several embodiments which are illustrated in the accompanying drawings, in which.

DESCRIPTION OF THE PREFERRED EMBODIMENT

Figure 1:
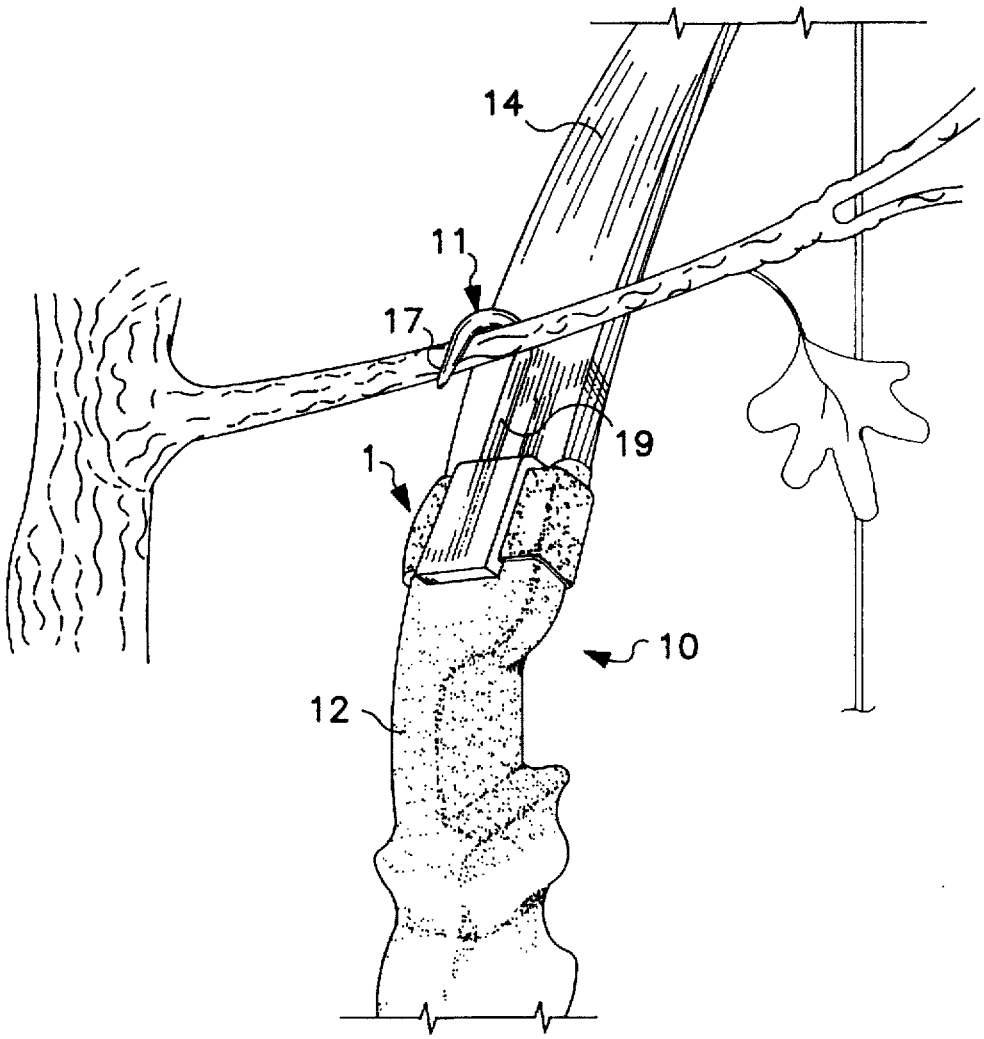
FIG. 1 shows a view of a bow hanger attached to an archery bow.
Figure 2:
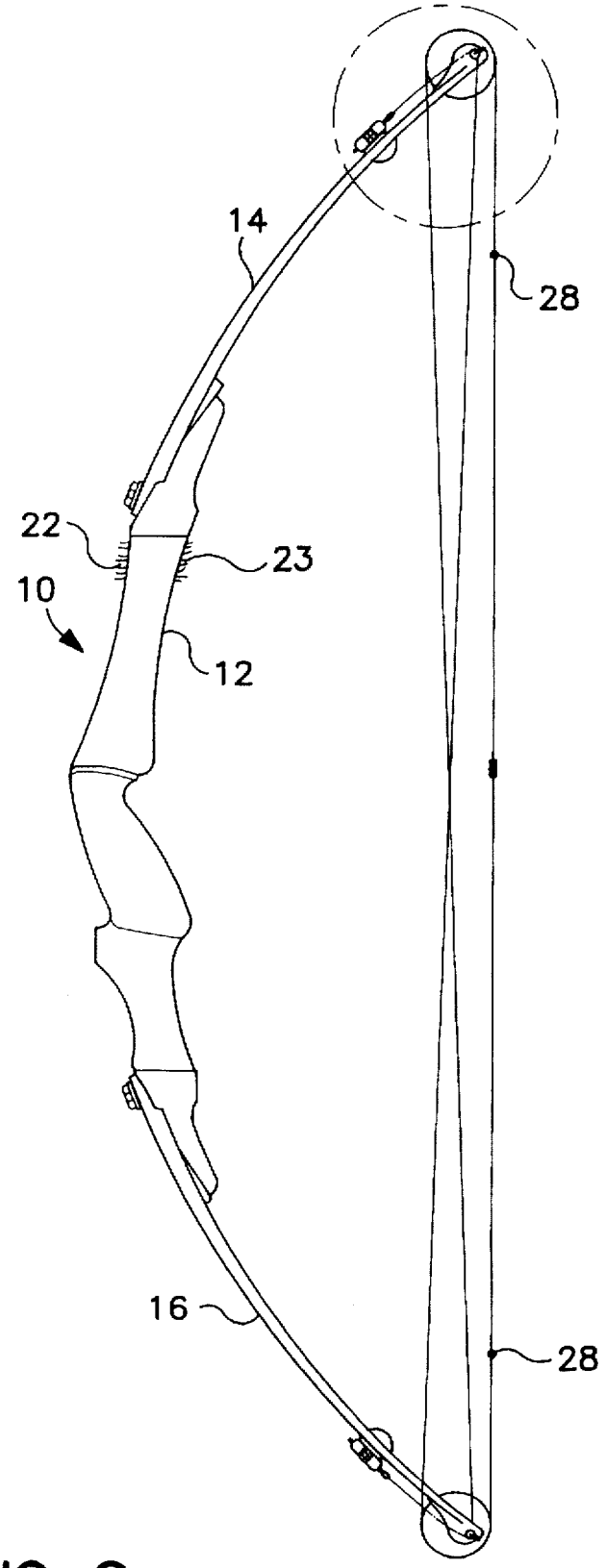
FIG. 2 shows a view of an archery bow.

As shown in FIG. 1, a bow hanger 1 can be attached to an archery bow 10. The archery bow 10 can include an upper bow limb 14 and a lower bow limb 16 (see FIG. 2), which two limbs 14 and 16 can be joined by a handle section 12. The bow hanger 1 can be provided with a hook element 11, which hook element 11 can be looped on a tree branch or other horizontal structure, to thereby provide support for the bow 10.

Figure 3:
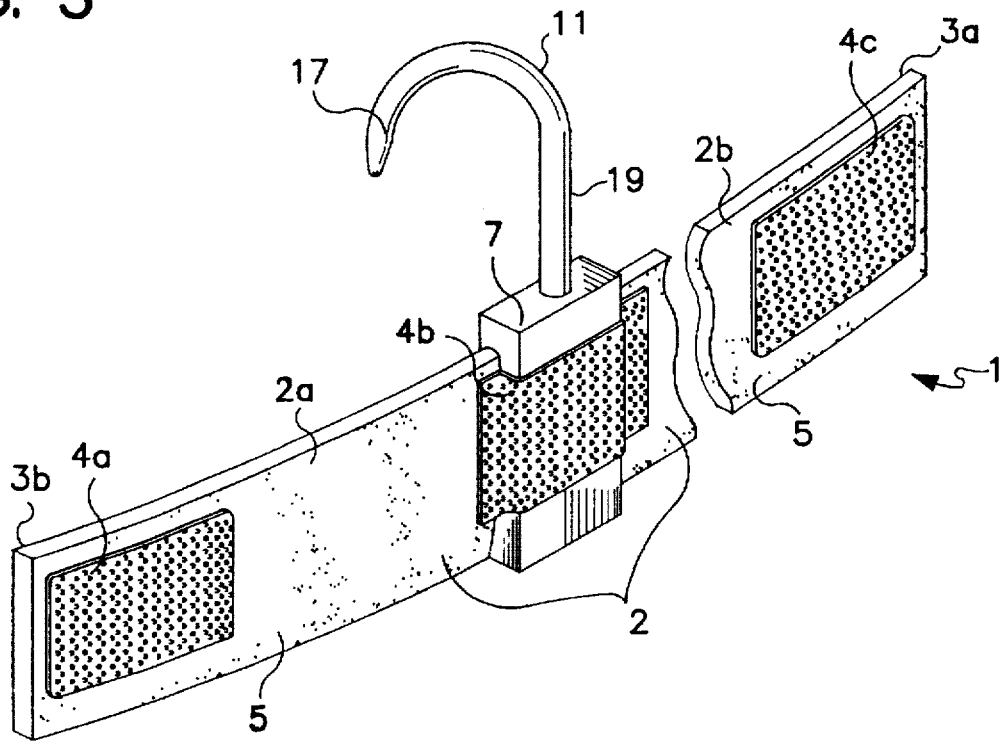
FIG. 3 shows a view of a bow hanger.

The hook element 11 can have a curved portion 17 and a straight spindle portion 19. The lower end of the straight spindle portion 19 can preferably be connected with a base structure 7, as shown in FIG. 3, of the bow hanger 1. The base structure 7 can be attached to an essentially linear, flexible strap 2, which flexible strap 2 can extend essentially perpendicular to the attached hook element 11. The flexible strap 2 can preferably include a pair of flexible arms 2*a* and 2*b*. The flexible arms 2*a* and 2*b* can be provided with a series of VELCRO fastening strips 4*a*, 4*b* and 4*c* arranged to provide VELCRO fasteners for the bow hanger 1.

In accordance with one embodiment of the present invention, to essentially firmly fasten the bow hanger 1 to the bow 10, a VELCRO strip 22 (see FIG. 2) can preferably be affixed to a portion of the handle section 12 of the bow 10, which VELCRO strip 22 can thereby be fastened to the complementary VELCRO strip 4*b* (see FIG. 3) of the flexible strap 2 of the bow hanger 1. By essentially wrapping the flexible strap 2 of the bow hanger 1 around the VELCRO strip 22 of the bow 10, the complementary VELCRO strip 4*b* of the flexible strap 2, e.g. a hook portion, can overlay the VELCRO strip 22, e.g. a loop portion, of the bow 10. The hook portion of the VELCRO strip 4*b* of the bow hanger 1 can then engage with the loop portion of the VELCRO strip 22 of the bow 10 thereby essentially securely connecting the bow hanger 1 with the bow 10. In addition, a VELCRO strip 23 can be affixed to the back of the bow 10. By essentially wrapping the flexible strap 2 around the bow 10, complementary VELCRO strip 4*c* of the first end 3*a* of the flexible strap 2 can be pressed into engagement with the VELCRO strip 23 of the bow 10. The hook portion, for example, of the VELCRO strip 4*c* of the bow hanger 1 can then engage with the loop portion, for example, of the VELCRO strip 23 of the bow 10 thereby essentially providing an additional connection of the bow hanger 1 with the bow 10.

In accordance with one embodiment of the present invention, the bow hanger 1 can be additionally fastened to the bow 10 whereby a first end 3*a* of the flexible strap 2 of the bow hanger 1 can have a loop portion of a VELCRO strip 4*d*. A second end 3*b* of the flexible strap 2 of the bow hanger 1 can have a complementary hook portion of a VELCRO strip 4*a* attached thereon. After wrapping the flexible strap 2 of the bow hanger 1 around the bow 10, the first end 3*a* and the second end 3*b* of the flexible strap 2 can be secured to one another by overlaying and engaging the complementary VELCRO portion 4*a* with the VELCRO portion 4*d* to thereby attach the flexible strap 2 of the bow hanger 1 onto the bow 10.

By essentially joining the complementary hook and loop portions of the bow hanger 1 and the bow 10, the bow hanger 1 can be firmly fixed on the bow 10. The bow hanger 1 can thus be releasably attached to the bow 10 and essentially cannot interfere with the operation of the bow 10, since the hook element 11 of the bow hanger 1 can face forwardly of the bow 10 and away from bowstring 28 (see FIG. 2).

In accordance with one embodiment of the present invention, the VELCRO strips 4*a*, 4*b* and 4*c* can be essentially permanently attached to the flexible strap 2 by using an adhesive and/or by sewing, e.g. machine stitching, the VELCRO strips 4*a*, 4*b* and 4*c* onto the flexible strap 2.

The bow hanger 1 can be quickly released from the bow 10 by essentially pulling the first end 3*a* of the flexible strap 2 away from the second end 3*b* of the flexible strap 2, and then by unwrapping the flexible strap 2 from around the bow 10 and disengaging the VELCRO strip 4*b* of the flexible strap 2 and the complementary VELCRO strip 22 of the bow 10 from one another.

After attaching the bow hanger 1 to the bow 10, the bow 10 can be supported by placing the curved portion 17 of the hook element 11 over a branch of a tree, for example, or other available structure. While supported in this manner, the how 10 can hang free from the ground whereby the bow 10 can no longer be subjected to damage that could otherwise result from exposure to dirt, snow, or water. By supporting the bow 10 in this manner, the bow 10 can also essentially be protected from being stepped on or knocked over. Therefore, the present invention can support the bow 10 and can thereby essentially prevent the bow 10 from sustaining damage such as rusting or warping due to exposure to water or dampness from the ground. In addition, the bow hanger 1 can support the bow 10 so that the surface of the bow 10 essentially cannot be chipped or scraped by rocks and dirt.

In addition, the bow hanger 1 can be used when the hunter is climbing up into a tree stand. It can be possible to attach a rope, or the like, to the hook element 11 of the bow hanger 1 and to pull the bow 10 upward to the stand without causing damage to the bow 10.

The bow hanger 1, according to the present invention, can also safely and effectively support the bow 10 during storage, when the bow 10 is not in use. When the bow 10 is stored, the operative and ornamental elements of the bow 10 should not be in contact with other surfaces. Rugged surfaces, such as a nail or a metal rack, can scratch the surface of the bow 10. Additionally, by storing the bow 10 on a rack or shelf, a constant and direct force may be applied to the delicate operative components of the bow 10 whereby the accurate and precise settings of the operative components may be altered. To essentially prevent such damage during storage, the bow hanger 1 can be quickly attached to the bow 10 whereby the bow 10 can be supported on a wire or pipe, for example. The bow 10 can thus be free from damage since the operative and ornamental parts of the bow 10 essentially cannot come into contact with other surfaces.

By using the VELCRO fastening strips 4a, 4b, 4c and 4d, the bow hanger 1 of the present invention can preferably be adapted to various bows and various sizes of bows. Therefore the design of the present invention does not necessarily require the use of buckles to adjust the size of the bow hanger 1. Since the flexible arms 2a and 2b can be held together by engaging the VELCRO fastening strip 4a with the VELCRO strip 4d, the two flexible arms 2a and 2b need essentially only be pressed together such that the size of the bow hanger 1 can be adjusted to the size of the bow 10. A particularly advantageous feature of the present invention, therefore, is that the use of the VELCRO fastening strips 4a, 4b, 4c and 4d of the bow hanger 1 and the VELCRO fastening strips 22 and 23 of the bow 10 can permit a relatively easy adjustment of the bow hanger 1 to the size of the bow 10.

Figure 4:
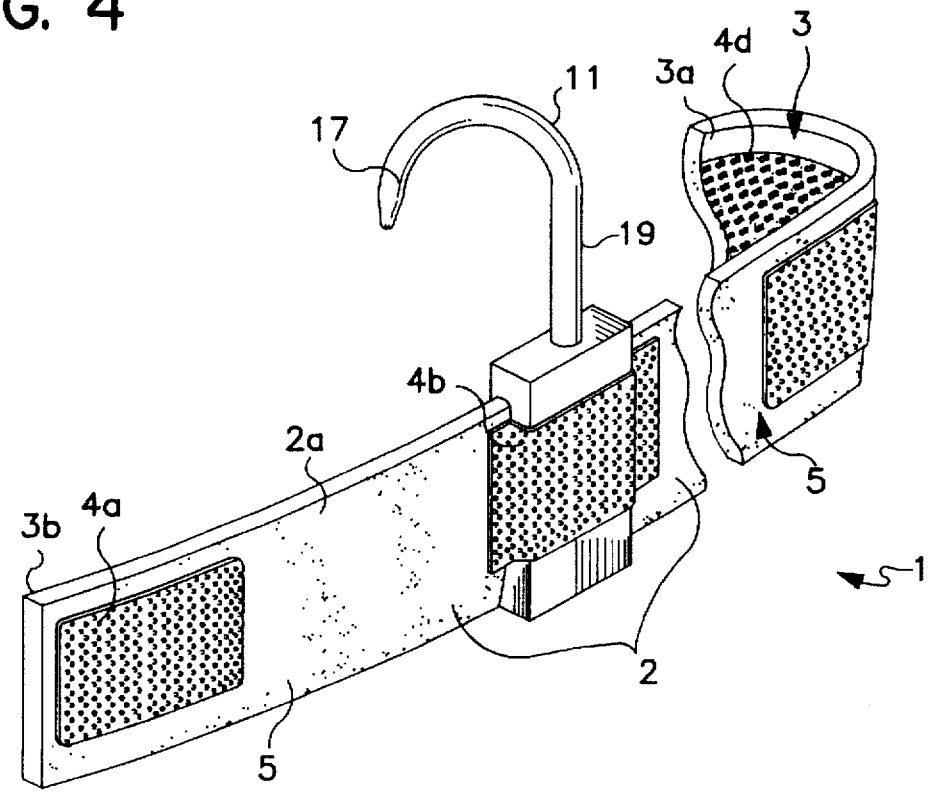
FIG. 4 shows an additional view of the bow hanger as shown in FIG. 3.

In accordance with one embodiment of the present invention, as shown in FIG. 4, the flexible strap 2 can preferably have a front surface 3 and a back surface 5, which back surface 5 faces away from the front surface 3. The first end 3a of the front surface 3 of the flexible strap 2 can preferably have the loop portion of a VELCRO strip 4d attached thereon. The second end 3b of the back surface 5 of the flexible strap 2 can preferably have a hook portion of a VELCRO strip 4a attached thereon to the flexible strap 2. The bow hanger 1 can be wrapped around the VELCRO strips 22 and 23 (see FIG. 2) of the bow 10 such that the hook portion of VELCRO strip 4b of the bow hanger 1 can be attached to the loop portion 22 of the bow 10. The hook portion of VELCRO strip 4c of the first end 3a of the flexible strap 2 can be placed on and engaged with the loop portion 23 of the bow 10. The second end 3b of the flexible strap 2 can then be wrapped around and can overlap the first end 3a of the flexible strap 2. The hook portion of VELCRO strip 4a on the second end 3b of the flexible strap 2 can then be pressed into contact with the complementary loop portion of VELCRO strip 4d of the first end 3a to thereby securely close the flexible strap 2 of the bow hanger 1.

It should be noted, with regard to the description above, that the hook and loop portions of VELCRO may be interchangeably attached to either of the bow 10 or the flexible strap 2 of the bow hanger 1 without making a substantial difference in the function of the present invention.

In accordance with an embodiment of the present invention, for the purpose of essentially securely fastening the bow hanger 1 onto the bow 10, the VELCRO strips 22 and 23 of the bow 10 can be attached to an upper portion of the handle section 12 of the bow 10, as described hereinabove. Alternatively, the VELCRO strips 22 and 23 can be attached to a lower portion of the upper limb 14 of the bow 10. The VELCRO strips 22 and 23 of the bow 10 can preferably be attached with the complementary VELCRO strips 4b and 4c, respectively. For the purpose of securely attaching the VELCRO strip 4b, the back of the VELCRO strip 4b can preferably be affixed onto the side of the base structure 7 adjacent the back surface 5 of the flexible strap 2. In addition, the ends of the VELCRO strip 4b can be affixed and/or stitched onto the back surface 5 of the flexible strap 2. Since the VELCRO strip 4b can thereby be connected with and in contact with both the flexible strap 2 and the base structure 7, the VELCRO strip 4b can serve to fasten the flexible strap 2 to the base structure 7.

The VELCRO strips 22 and 23 of the bow 10 can preferably be attached to the bow 10 by affixing with glue, for example. In addition, the VELCRO strips 22 and 23 can be affixed to the belly and the back of the bow 10, respectively. Alternatively, the VELCRO strips 22 and 23 can be affixed to circumferentially surround an upper portion of the handle section 12 of the bow 10, or the VELCRO strips 22 and 23 can be affixed to circumferentially surround a lower portion of the upper limb 14 of the bow 10. The flexible arms 2a and 2b can have an essentially sufficient length to permit the bow hanger 1 to encircle the VELCRO strips 22 and 23 of bow 10.

By essentially affixing the VELCRO strips 22 and 23 of the bow 10 adjacent the upper portion of the handle section 12 of the bow 10, the weight of the bow 10 can be essentially balanced and supported by the bow hanger 1 when the hook element 11 is hooked on a branch of a tree or the like.

By essentially fastening the VELCRO strips 22 and 23 onto the bow 10 by means of an adhesive such as a glue or an epoxy, the bow hanger 1 can be firmly fastened to the bow 10 without essentially causing damage to the bow 10. For the purpose of removing the VELCRO strips 22 and 23 from the bow 10, or replacing the same, the VELCRO strips 22 and 23 can be pulled off the surface of the bow 10. Any residual glue or epoxy can then be essentially easily removed by the use of a solvent or similar non-abrasive compound.

In accordance with one embodiment of the present invention, the hook element 11 and the flexible strap 2 of the bow hanger 1 can preferably be designed as an integrated structure wherein the hook element 11 can be a constituent component of the flexible strap 2.

Figure 5:
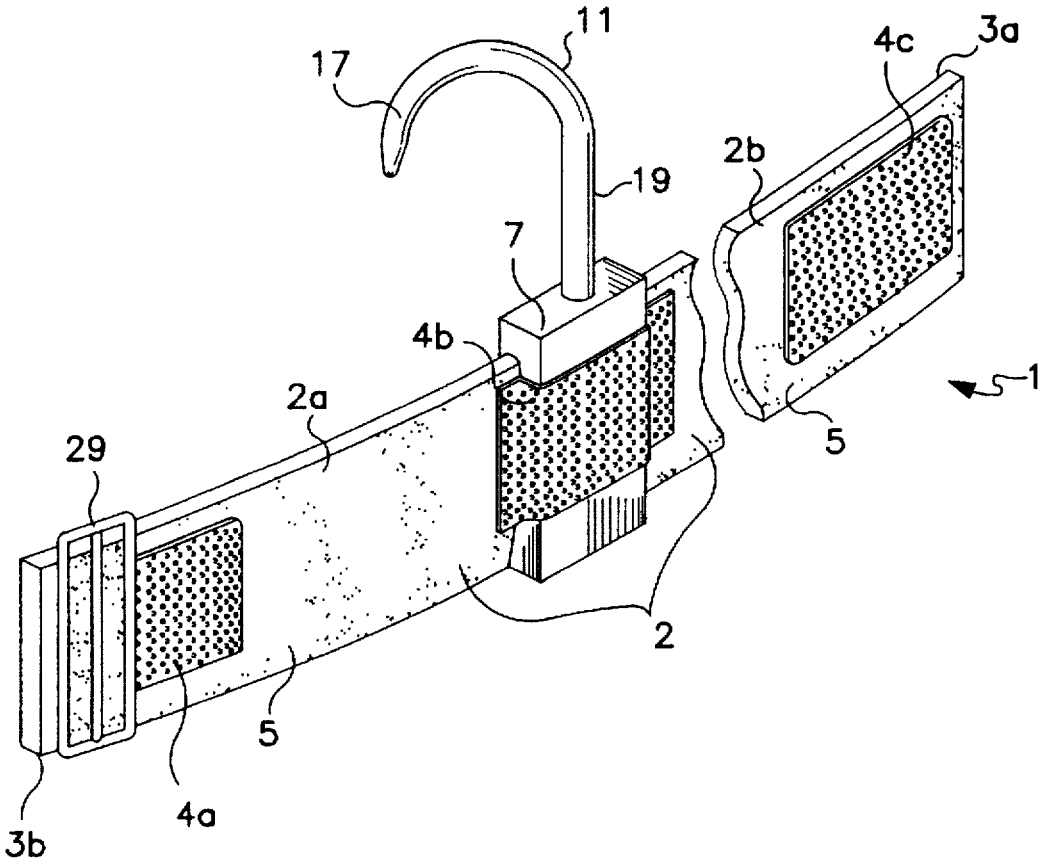
FIG. 5 shows an additional embodiment of the bow hanger showing a buckle.

In accordance with one embodiment of the present invention, the second end 3b of the bow hanger 1 can include a buckle 29, as shown in FIG. 5. The bow hanger 1 can be wrapped around the bow 10 such that the first end 3a of the flexible strap 2 can be inserted into the buckle. The complementary VELCRO strips 4a, 4b, 4c or 4d of the bow hanger 1 can be pressed into engagement with the corresponding VELCRO strips 22 and 23 of the bow 10.

Some examples of archery bows and bow hangers which may be utilized in accordance with the present invention may be found in the following U.S. Patents: U.S. Pat. No. 5,183,231 entitled "Bow Pod or Holder"; U.S. Pat. No. 5,310,150 entitled "Tree Mounted Archery Bow Holder"; U.S. Pat. No. 4,889,307 entitled "Bow Hanger"; U.S. Pat. No. 5,205,523 entitled "Portable Light-weight Hanger"; U.S. Pat. No. 5,172,679 entitled "Modular Construction for Compound Archery Bow"; and U.S. Pat. No. 4,957,094 entitled "Compound Archery Bow with Non-stretch Bowstring and Eccentrics for Securing Same" to Hoyt/Easton Archery Company.

Some examples of VELCRO fasteners which may utilized in accordance with the present invention may be found in the following U.S. Patents: U.S. Pat. No. 4,951,910 entitled "Vertically Adjustable VELCRO Strap Drink Holder"; U.S. Pat. No. 4,759,963 entitled "Fishing Pole Fastening Device"; and U.S. Pat. No. 4,890,571 entitled "Deer Scarecrow".

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A bow hanger for an archery bow, said bow hanger comprising:

means for supporting an archery bow;

said supporting means having a first portion and a second portion;

said first portion of said supporting means comprising a hook;

said second portion of said supporting means comprising a flexible material;

means for releasably attaching said supporting means substantially adjacent an upper portion of an archery bow;

said means for releasably attaching being disposed on at least one of:

said flexible material of said supporting means; and substantially adjacent an upper portion of an archery bow;

said means for releasably attaching said supporting means comprising a plurality of complementary hook and eyelet fastening strips, said hook and eyelet fastening strips being pressure sensitive with respect to one another;

said plurality of hook and eyelet fastening strips comprising at least one hook portion;

said plurality of hook and eyelet fastening strips further comprising at least one eyelet portion;

said at least one hook portion being disposed on one of: said flexible material of said supporting means, and substantially adjacent an upper portion of an archery bow;

said at least one eyelet portion being disposed on the other of: said flexible material of said supporting means, and substantially adjacent an upper portion of an archery bow;

means for fastening said at least one hook portion onto said one of: said flexible material of said supporting means, and substantially adjacent an upper portion of an archery bow;

means for fastening said at least one eyelet portion onto the other of: said flexible material of said supporting means, and substantially adjacent an upper portion of an archery bow;

said hook of said supporting means comprising a straight portion and a curved portion;

said flexible material of said supporting means comprising a flexible strap;

said flexible strap extending substantially perpendicular to said hook of said supporting means;

said flexible strap of said supporting means having a first side and a second side;

said first side of said flexible strap facing toward said curved portion of said hook of said supporting means;

said second side of said flexible strap facing away from said first side of said flexible strap;

said flexible strap comprising said at least one hook portion disposed on said second side of said flexible strap;

said at least one eyelet portion being disposed adjacent an upper portion of an archery bow;

said flexible strap comprising said means for fastening said at least one hook portion;

said means for fastening said at least one hook portion comprising at least one of:

means for glueing said at least one hook portion onto said second side of said flexible strap; and means for stitching said at least one hook portion onto said second side of said flexible strap;

said means for fastening said at least one eyelet portion for being disposed substantially adjacent an upper portion of an archery bow;

said means for fastening said at least one eyelet portion comprising means for glueing said at least one eyelet portion substantially adjacent an upper portion of an archery bow;

said at least one hook portion comprising a plurality of hook portions;

said second side of said flexible strap having a first end and a second end;

said flexible strap having a central portion disposed substantially between said first end and said second end of said second side of said flexible strap;

said plurality of hook portions comprising a first hook portion disposed adjacent said first end of said second side of said flexible strap;

said plurality of hook portions further comprising a second hook portion disposed adjacent said central portion of said second side of said flexible strap;

said plurality of hook portions further comprising a third hook portion disposed adjacent said second end of said second side of said flexible strap;

said first side of said flexible strap having a first end and a second end;

said second end of said first side of said flexible strap comprising an additional eyelet portion;

means for fastening said additional eyelet portion onto said second end of said first side of said flexible strap;

said at least one eyelet portion of an archery bow comprising a first portion and a second portion;

said first portion of said at least one eyelet portion of an archery bow being disposed on a belly of an archery bow;

said second portion of said at least one eyelet portion of an archery bow being disposed on a back of an archery bow;

said second hook portion of said flexible strap for being disposed on, and engaged with, said first portion of said at least one eyelet portion of an archery bow;

said flexible strap for being wrapped around an archery bow;

said third hook portion of said flexible strap for being disposed on, and engaged with, said second portion of said at least one eyelet portion of an archery bow; and said first hook portion of said flexible strap for being disposed on, and engaged with, said additional eyelet portion of said second end of said first side of said flexible strap.

2. The bow hanger according to claim 1, further comprising:

means for connecting said hook and said flexible strap;

said means for connecting said hook and said flexible strap comprising a base;

said base having a first side and a second side;

said first side of said base being disposed adjacent said first side of said flexible strap;

said second side of said base being disposed adjacent said second side of said flexible strap;

said second hook portion of said flexible strap for being affixed on said second side of said base; and said second hook portion comprising means for fastening said base and said flexible strap to one another.

3. A bow hanger for an archery bow, said bow hangar comprising:

means for supporting an archery bow;

said supporting means having a first portion and a second portion;

said first portion of said supporting means comprising a hook;

said second portion of said supporting means comprising a flexible material;

means for releasably attaching said supporting means substantially adjacent an upper portion of an archery bow;

said means for releasably attaching being disposed on at least one of:

said flexible material of said supporting means; and substantially adjacent an upper portion of an archery bow;

said means for releasably attaching said supporting means comprising a plurality of complementary hook and eyelet fastening strips, said hook and eyelet fastening strips being pressure sensitive with respect to one another;

said plurality of hook and eyelet fastening strips comprising at least one hook portion;

said plurality of hook and eyelet fastening strips further comprising at least one eyelet portion;

said at least one hook portion being disposed on one of:

said flexible material of said supporting means, and substantially adjacent an upper portion of an archery bow;

said at least one eyelet portion being disposed on the other of: said flexible material of said supporting means, and substantially adjacent an upper portion of an archery bow;

means for fastening said at least one hook portion onto said one of: said flexible material of said supporting means, and substantially adjacent an upper portion of an archery bow;

means for fastening said at least one eyelet portion onto the other of: said flexible material of said supporting means, and substantially adjacent an upper portion of an archery bow;

said hook of said supporting means comprising a straight portion and a curved portion;

said flexible material of said supporting means comprising a flexible strap;

said flexible strap extending substantially perpendicular to said hook of said supporting means;

said flexible strap of said supporting means having a first side and a second side;

said first side of said flexible strap facing toward said curved portion of said hook of said supporting means;

said second side of said flexible strap facing away from said first side of said flexible strap;

said flexible strap comprising said at least one hook portion disposed on said second side of said flexible strap;

said at least one eyelet portion being disposed adjacent an upper portion of an archery bow;

said flexible strap comprising said means for fastening said at least one hook portion;

said means for fastening said at least one hook portion comprising at least one of:

means for glueing said at least one hook portion onto said second side of said flexible strap; and means for stitching said at least one hook portion onto said second side of said flexible strap;

said means for fastening said at least one eyelet portion for being disposed substantially adjacent an upper portion of an archery bow;

said means for fastening said at least one eyelet portion comprising means for glueing said at least one eyelet portion substantially adjacent an upper portion of an archery bow;

said at least one hook portion comprising a plurality of hook portions;

said second side of said flexible strap having a first end and a second end;

said flexible strap having a central portion disposed substantially between said first end and said second end of said second side of said flexible strap;

said first end of said second side of said flexible strap comprising buckle means;

means for connecting said buckle means onto said first end of said flexible strap;

said plurality of hook portions comprising a first hook portion disposed substantially adjacent said buckle means of said first end of .said flexible strap;

said plurality of hook portions further comprising a second hook portion disposed adjacent said central portion of said second side of said flexible strap;

said hook being disposed substantially adjacent said second hook portion;

said first side of said flexible strap having a first end and a second end;

said first side of said flexible strap having a central portion disposed substantially between said first end and said second end of said first side of said flexible strap;

said plurality of hook portions further comprising a third hook portion;

said second end of said first side of said flexible strap comprising said third hook portion;

said central portion of said first side of said flexible strap comprising an additional eyelet portion;

means for fastening said additional eyelet portion onto said central portion of said first side of said flexible strap;

said at least one eyelet portion of an archery bow comprising a first portion and a second portion;

said first portion of said at least one eyelet portion of an archery bow being disposed on a belly of an archery bow;

said second portion of said at least one eyelet portion of an archery bow being disposed on a back of an archery bow;

said first hook portion of said flexible strap for being disposed on, and engaged with, said first portion of said at least one eyelet portion of an archery bow;

said flexible strap for being wrapped around an archery bow;

said second end of said flexible strap for being inserted into said buckle means of said first end of said flexible strap;

said second hook portion of said flexible strap for being disposed on, and engaged with, said second portion of said at least one eyelet portion of an archery bow; and said third hook portion of said flexible strap for being disposed on, and engaged with, said additional eyelet portion of said central portion of said first side of said flexible strap.

4. The bow hanger according to claim 3, further comprising:

means for connecting said hook and said flexible strap;

said means for connecting said hook and said flexible strap comprising a base;

said base having a first side and a second side;

said first side of said base being disposed adjacent said first side of said flexible strap;

said second side of said base being disposed adjacent said second side of said flexible strap;

said first hook portion of said flexible strap being affixed on said second side of said base; and said first hook portion comprising means for fastening said base and said flexible strap to one another.

5. An archery bow comprising:

a handle section having an upper end and a lower end;

said handle section defining a longitudinal axis extending substantially between said upper end and said lower end of said handle section;

an upper limb section extending from said upper end of said handle section;

a lower limb section extending from said lower end of said handle section;

said upper limb section and said lower limb section each having a free end facing away from said handle section;

a bowstring extending between said free end of said upper limb section and said free end of said lower limb section;

said bowstring being disposed rearwardly of said handle section;

means for supporting said archery bow;

said supporting means having an upper portion and a lower portion;

said upper portion of said supporting means comprising a hook;

said hook being disposed substantially parallel to said longitudinal axis;

said lower portion of said supporting means comprising a flexible material;

means for releasably attaching said supporting means substantially adjacent said upper end of said handle section of said archery bow;

said means for releasably attaching being disposed on at least one of:

said flexible material of said supporting means; and substantially adjacent said upper end of said handle section of said archery bow;

said means for releasably attaching said supporting means comprising a plurality of hook and eyelet fastening strips, said hook and eyelet fastening strips being pressure sensitive with respect to one another;

said plurality of hook and eyelet fastening strips comprising at least one hook portion;

said plurality of hook and eyelet fastening strips further comprising at least one eyelet portion;

said at least one hook portion being disposed on one of: said flexible material of said supporting means, and substantially adjacent said upper end of said handle section of said archery bow;

said at least one eyelet portion being disposed on the other of: said flexible material of said supporting means, and substantially adjacent said upper end of said handle section of said archery bow;

means for fastening said at least one hook portion onto said one of: said flexible material of said supporting means, and substantially adjacent said upper end of said handle section of said archery bow;

means for fastening said at least one eyelet portion onto the other of: said flexible material of said supporting means, and substantially adjacent said upper end of said handle section of said archery bow;

said hook of said supporting means comprising a straight portion and a curved portion;

said flexible material of said supporting means comprising a flexible strap;

said flexible strap extending substantially perpendicular to said hook of said supporting means;

said flexible strap of said supporting means having a first side and a second side;

said first side of said flexible strap facing toward said curved portion of said hook of said supporting means;

said second side of said flexible strap facing away from said first side of said flexible strap;

said flexible strap comprising said at least one hook portion disposed on said second side of said flexible strap;

said at least one eyelet portion being disposed adjacent said upper end of said handle section of said archery bow;

said flexible strap comprising said means for fastening said at least one hook portion;

said means for fastening said at least one hook portion comprising at least one of:

means for glueing said at least one hook portion onto said second side of said flexible strap; and means for stitching said at least one hook portion onto said second side of said flexible strap;

said means for fastening said at least one eyelet portion being disposed substantially adjacent said upper end of said handle section of said archery bow;

said means for fastening said at least one eyelet portion comprising means for glueing said at least one eyelet portion substantially adjacent said upper end of said handle section of said archery bow;

said at least one hook portion comprising a plurality of hook portions;

said second side of said flexible strap having a first end and a second end;

said flexible strap having a central portion disposed substantially between said first end and said second end of said second side of said flexible strap;

said plurality of hook portions comprising a first hook portion disposed adjacent said first end of said second side of said flexible strap;

said plurality of hook portions further comprising a second hook portion disposed adjacent said central portion of said second side of said flexible strap;

said plurality of hook portions further comprising a third hook portion disposed adjacent said second end of said second side of said flexible strap;

said first side of said flexible strap having a first end and a second end;

said second end of said first side of said flexible strap comprising an additional eyelet portion;

means for fastening said additional eyelet portion onto said second end of said first side of said flexible strap;

said at least one eyelet portion of an archery bow comprising a first portion and a second portion;

said archery bow comprising a belly portion;

said first portion of said at least one eyelet portion of said archery bow being disposed on said belly portion of said archery bow;

said archery bow comprising a back portion;

said second portion of said at least one eyelet portion of said archery bow being disposed on said back portion of said archery bow;

said second hook portion of said flexible strap for being disposed on, and engaged with, said first portion of said at least one eyelet portion of said archery bow;

said flexible strap being wrapped around said back portion of said archery bow;

said third hook portion of said flexible strap for being disposed on, and engaged with, said second portion of said at least one eyelet portion of said archery bow; and said first hook portion of said flexible strap being disposed on, and engaged with, said additional eyelet portion of said second end of said first side of said flexible strap.

6. The archery bow according to claim 5, further comprising:

means for connecting said hook and said flexible strap;

said means for connecting said hook and said flexible strap comprising a base;

said base having a first side and a second side;

said first side of said base being disposed adjacent said first side of said flexible strap;

said second side of said base being disposed adjacent said second side of said flexible strap;

said second hook portion of said flexible strap for being affixed on said second side of said base; and said second hook portion comprising means for fastening said base and said flexible strap to one another.

7. An archery bow comprising:

a handle section having an upper end and a lower end;

said handle section defining a longitudinal axis extending substantially between said upper end and said lower end of said handle section;

an upper limb section extending from said upper end of said handle section;

a lower limb section extending from said lower end of said handle section;

said upper limb section and said lower limb section each having a free end facing away from said handle section;

a bowstring extending between said free end of said upper limb section and said free end of said lower limb section;

said bowstring being disposed rearwardly of said handle section;

means for supporting said archery bow;

said supporting means having an upper portion and a lower portion;

said upper portion of said supporting means comprising a hook;

said hook being disposed substantially parallel to said longitudinal axis;

said lower portion of said supporting means comprising a flexible material;

means for releasably attaching said supporting means substantially adjacent said upper end of said handle section of said archery bow;

said means for releasably attaching being disposed on at least one of:

said flexible material of said supporting means; and substantially adjacent said upper end of said handle section of said archery bow;

said means for releasably attaching said supporting means comprising a plurality of hook and eyelet fastening strips, said hook and eyelet fastening strips being pressure sensitive with respect to one another;

said plurality of hook and eyelet fastening strips comprising at least one hook portion;

said plurality of hook and eyelet fastening strips further comprising at least one eyelet portion;

said at least one hook portion being disposed on one of:

said flexible material of said supporting means, and substantially adjacent said upper end of said handle section of said archery bow;

said at least one eyelet portion being disposed on the other of: said flexible material of said supporting means, and substantially adjacent said upper end of said handle section of said archery bow;

means for fastening said at least one hook portion onto said one of: said flexible material of said supporting means, and substantially adjacent said upper end of said handle section of said archery bow;

means for fastening said at least one eyelet portion onto the other of: said flexible material of said supporting means, and substantially adjacent said upper end of said handle section of said archery bow;

said hook of said supporting means comprising a straight portion and a curved portion;

said flexible material of said supporting means comprising a flexible strap;

said flexible strap extending substantially perpendicular to said hook of said supporting means;

said flexible strap of said supporting means having a first side and a second side;

said first side of said flexible strap facing toward said curved portion of said hook of said supporting means;

said second side of said flexible strap facing away from said first side of said flexible strap;

said flexible strap comprising said at least one hook portion disposed on said second side of said flexible strap; and said at least one eyelet portion being disposed adjacent said upper end of said handle section of said archery bow;

said flexible strap comprising said means for fastening said at least one hook portion;

said means for fastening said at least one hook portion comprising at least one of:

means for glueing said at least one hook portion onto said second side of said flexible strap; and means for stitching said at least one hook portion onto said second side of said flexible strap;

said means for fastening said at least one eyelet portion being disposed substantially adjacent said upper end of said handle section of said archery bow;

said means for fastening said at least one eyelet portion comprising means for glueing said at least one eyelet portion substantially adjacent said upper end of said handle section of said archery bow;

said at least one hook portion comprising a plurality of hook portions;

said second side of said flexible strap having a first end and a second end;

said flexible strap having a central portion disposed substantially between said first end and said second end of said second side of said flexible strap;

said first end of said second side of said flexible strap comprising buckle means;

means for connecting said buckle means onto said first end of said flexible strap;

said plurality of hook portions comprising a first hook portion disposed substantially adjacent said buckle means of said first end of said flexible strap;

said plurality of hook portions further comprising a second hook portion disposed adjacent said central portion of said second side of said flexible strap;

said hook being disposed substantially adjacent said second hook portion;

said first side of said flexible strap having a first end and a second end;

said first side of said flexible strap having a central portion disposed substantially between said first end and said second end of said first side of said flexible strap;

said plurality of hook portions further comprising a third hook portion;

said second end of said first side of said flexible strap comprising said third hook portion;

said central portion of said first side of said flexible strap comprising an additional eyelet portion;

means for fastening said additional eyelet portion onto said central portion of said first side of said flexible strap;

said at least one eyelet portion of said archery bow comprising a first portion and a second portion;

said archery bow comprising a belly portion;

said first portion of said at least one eyelet portion of an archery bow being disposed on said belly portion of said archery bow;

said archery bow comprising a back portion;

said second portion of said at least one eyelet portion of an archery bow being disposed on said back portion of said archery bow;

said first hook portion of said flexible strap being disposed on, and engaged with, said first portion of said at least one eyelet portion of said archery bow;

said flexible strap being wrapped around said back portion of said archery bow;

said second end of said flexible strap for being inserted into said buckle means of said first end of said flexible strap;

said second hook portion of said flexible strap being disposed on, and engaged with, said second portion of said at least one eyelet portion of said archery bow; and said third hook portion of said flexible strap being disposed on, and engaged with, said additional eyelet portion of said central portion of said first side of said flexible strap.

8. The archery bow according to claim 7, further comprising:

means for connecting said hook and said flexible strap;

said means for connecting said hook and said flexible strap comprising a base;

said base having a first side and a second side;

said first side of said base being disposed adjacent said first side of said flexible strap;

said second side of said base being disposed adjacent said second side of said flexible strap;

said first hook portion of said flexible strap for being affixed on said second side of said base; and said first hook portion comprising means for fastening said base and said flexible strap to one another.

* * * * *